US005983662A

United States Patent [19]

Luetsch

[11] Patent Number: 5,983,662

[45] Date of Patent: Nov. 16, 1999

[54] SELF COOLING BEVERAGE COOLER

[76] Inventor: Guido Luetsch, Mommsenstrasse 24, Berlin, Germany, D-10629

[21] Appl. No.: 09/061,853

[22] Filed: Apr. 17, 1998

Related U.S. Application Data

[60] Provisional application No. 60/044,775, Apr. 21, 1997.

[51] Int. Cl.[6] ..... F25D 3/08

[52] U.S. Cl. ..... 62/457.4; 62/371; 62/315

[58] Field of Search ..... 62/371, 304, 315, 62/316, 457.4

[56] References Cited

U.S. PATENT DOCUMENTS

| | | | |
|---|---|---|---|
| 4,344,303 | 8/1982 | Kelly, Jr. | 62/530 |
| 4,782,670 | 11/1988 | Long et al. | 62/457 |
| 4,798,063 | 1/1989 | Rimmer | 62/457 |
| 4,989,415 | 2/1991 | Lombness | 62/372 |
| 5,022,235 | 6/1991 | Grissom | 62/457.4 |
| 5,361,604 | 11/1994 | Pier et al. | 62/457.4 |
| 5,802,865 | 9/1998 | Strauss | 62/259.3 |

*Primary Examiner*—Henry Bennett
*Assistant Examiner*—Melvin Jones
*Attorney, Agent, or Firm*—Michael S. Brandt

[57] ABSTRACT

The invention provides extreme convenience and flexibility in providing for cooled beverages at inconvenient places and times. This flexibility is provided by the invention's use of a cooling process which is not dependent on chemicals or power sources, that is, the evaporative process which can utilize any type of water: potable, non-potable, brackish, salt, etc. etc. This provides conservation of valuable potable water in locations where potable water is scarce, i.e., hiking and camping trips. In one embodiment, the container structure has holes in the outer wall to facilitate the evaporative process and the to be cooled beverage contained in a standard can is elevated off the container structure floor to also facilitate the evaporative process.

1 Claim, 2 Drawing Sheets

Typical can
Fig. 1-A
Part 2 [Top]
10
Part 1 [Body]
20
Sponge
30
20A
Cooling holes
40
20
20B
20C
Fig. 1-B Detail A

SELF COOLING BEVERAGE COOLER

CROSS REFERENCE TO RELATED APPLICATIONS

This application is a continuation-in-part of U.S. Provisional application Ser. No. 60/044,775, filed Apr. 21, 1997, the full disclosure of which is incorporated herein by reference.

BACKGROUND OF THE INVENTION

This invention relates to beverage coolers, and in particular describes a self cooling beverage container.

Beverage Containers which keep liquids cool are well known. Portable beverage coolers/holders are used in conjunction with many different recreational activities such as camping, boating, cycling, hiking etc. etc. For most people it is desirable in all these situations to have a cold beverage to drink, as it refreshes and provides added enjoyment to all recreational activities. The problem is that most normal beverage coolers, such as those designed for cyclists, do not have any practical method for cooling beverages inside cans or containers.

Up to now, the method of cooling usually involves an outside energy source to drive a compressor, or requires the container to be pre-cooled or frozen in a conventional cooling source (such as a refrigerator or freezer) and then removed and used. Once the useful cooling life of the pre-cooled container is over, it must be returned to a conventional cooling source in order for it to be once again useful as a cooling container.

SUMMARY OF THE INVENTION

The present invention is directed to and includes several advantages which are as follows:

The present invention uses the cooling effects of the evaporative cooling process, that is the cooling which occurs when water or liquid evaporates from the surface of a material, to cool a beverage within a standard beverage can. Such cooling is self sufficient and requires no outside cooling source in order for the can to do its cooling work. Natural room temperature water is used in the cooling process and solves problems associated with many of the previously known Beverage containers.

The invention effects cooling by evaporation of room temperature water, rather than relying on pre-cooled gel, ice or other refrigerant using an outside power source. Water is natural and universally available, and this cooler works with non-potable water as well, conserving the users potable water for consumption.

In a first aspect, the present invention provides an improved hand-held beverage cooler-container which consists of a container structure and evaporative sponge material. The sponge material, when whetted and placed in ambient air, draws heat away from the beverage by an evaporative process.

In another aspect, the invention provides for a hand-held container for cooling a beverage within a standard beverage can. The container comprises a cylindrical container structure having a first end and a second end. The container structure defines a cavity and having a plurality of radial openings sufficient for water to evaporate from a sponge material located within. The can can be placed inside the cavity so that the layer of sponge material comes in contact with the can. The can may be secured in the cavity from the top end with a screw top mechanism.

The invention can feature low production and assembly costs. The material used can be either plastic or metal, depending on what type of feature is most desired: Plastic for lightest weight and lowest production costs or metal for sturdiness and durability.

Other advantages of the invention are as follows:

Weight—Since the unit does not require a preinstalled liquid gel which needs to be frozen prior to obtaining any cooling. The unit weighs considerably less than other units.

Size—The size of the device is configured so that the unit as a whole is easy to grip and is the same basic size and figure as common cyclist's water bottles so that it can be used in standard cycle water bottle holders.

Safety/Health Factors—The unit uses water as a cooling agent, unlike many other devices which use chemical gels or other cooling agents.

Ease of use-The unit provides active cooling during consumption of the beverage. Also, since the cooling process can be initiated by merely wetting a sponge (which is contained around the beverage container) with ambient temperature/non potable water, it requires no pre-cooling.

Ease of production—The unit can be hand assembled and produced at a low cost. The unit's assembly requires no adhesives or special tooling and can be created with low production costs and efforts. The sponge which surrounds the unit and facilitates the evaporative cooling process can be easily assembled and can later be removed for cleaning and replaced.

Durability—Since the unit can be made of either plastic or metal, if durability is one of the desired qualities, the unit can be manufactured from metal. Since it can be pressed in one piece, there are no seems which can be weakened over time. Also since the sponge which provides the cooling process is easily removable, any tears or loss of elasticity in the sponge are easily repaired with a replacement.

Further objects and advantages of the invention will become apparent from a consideration of the drawings and ensuing description.

IN THE DRAWINGS

FIG. 1A is a frontal view of the preferred embodiment of the present invention with a cutout showing how the sponge material is contained inside the structure and showing how the standard soda can fits inside the sponge and within the cooler cavity. FIG. 1A also shows the threaded container lip with a threaded cap which can secure the soda can within the container. FIG. 1A also shows evaporative holes which allow the cooling agent to drawn out of the sponge to provide its cooling effect.

DETAILED DESCRIPTION OF THE DRAWINGS

Figure 1:
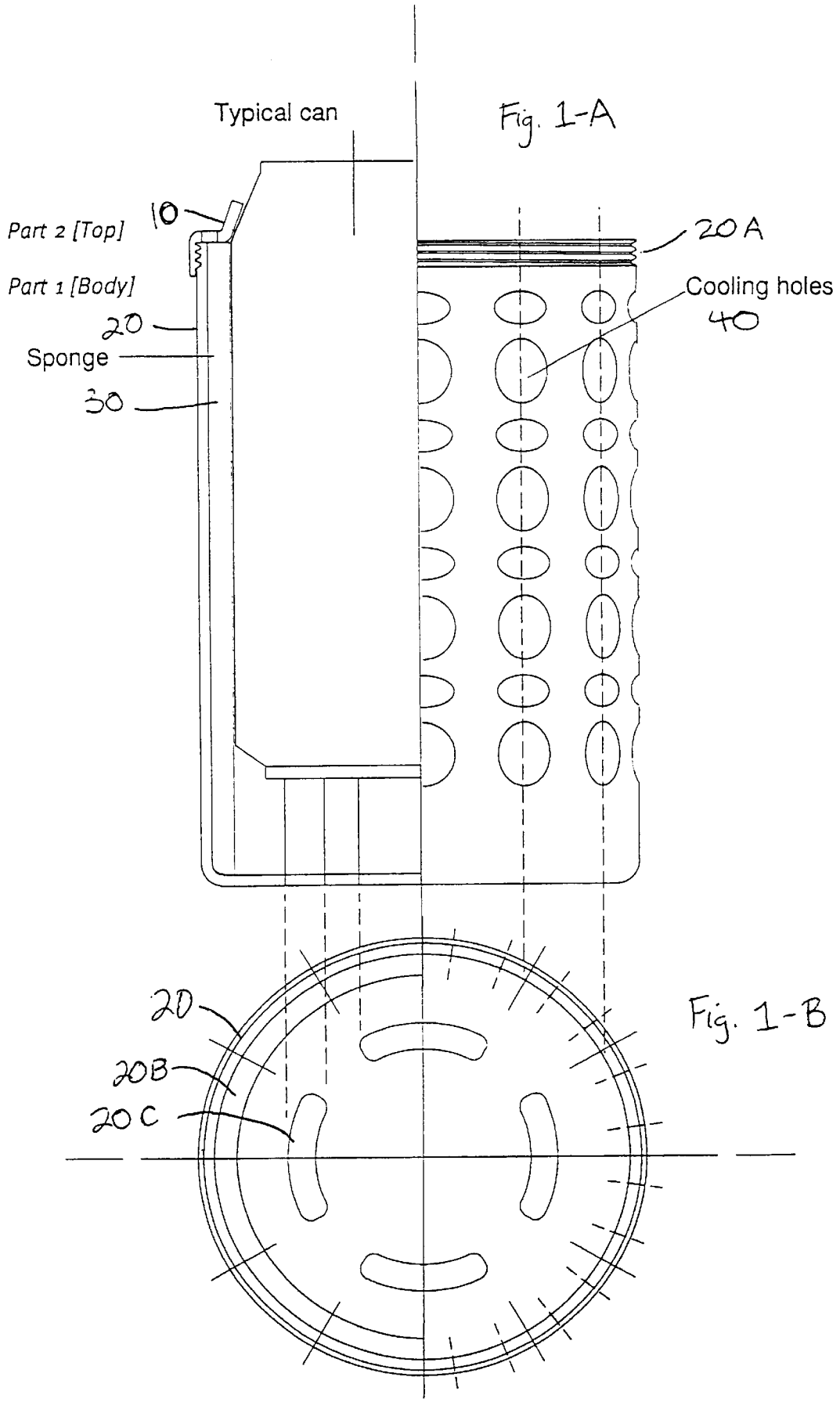
FIG. 1B is a bottom cut-away view of the preferred embodiment showing the placement of the staging lips which hold the soda can up off the container floor to provide for improved evaporative effect through improved air circulation.
Figure 2:
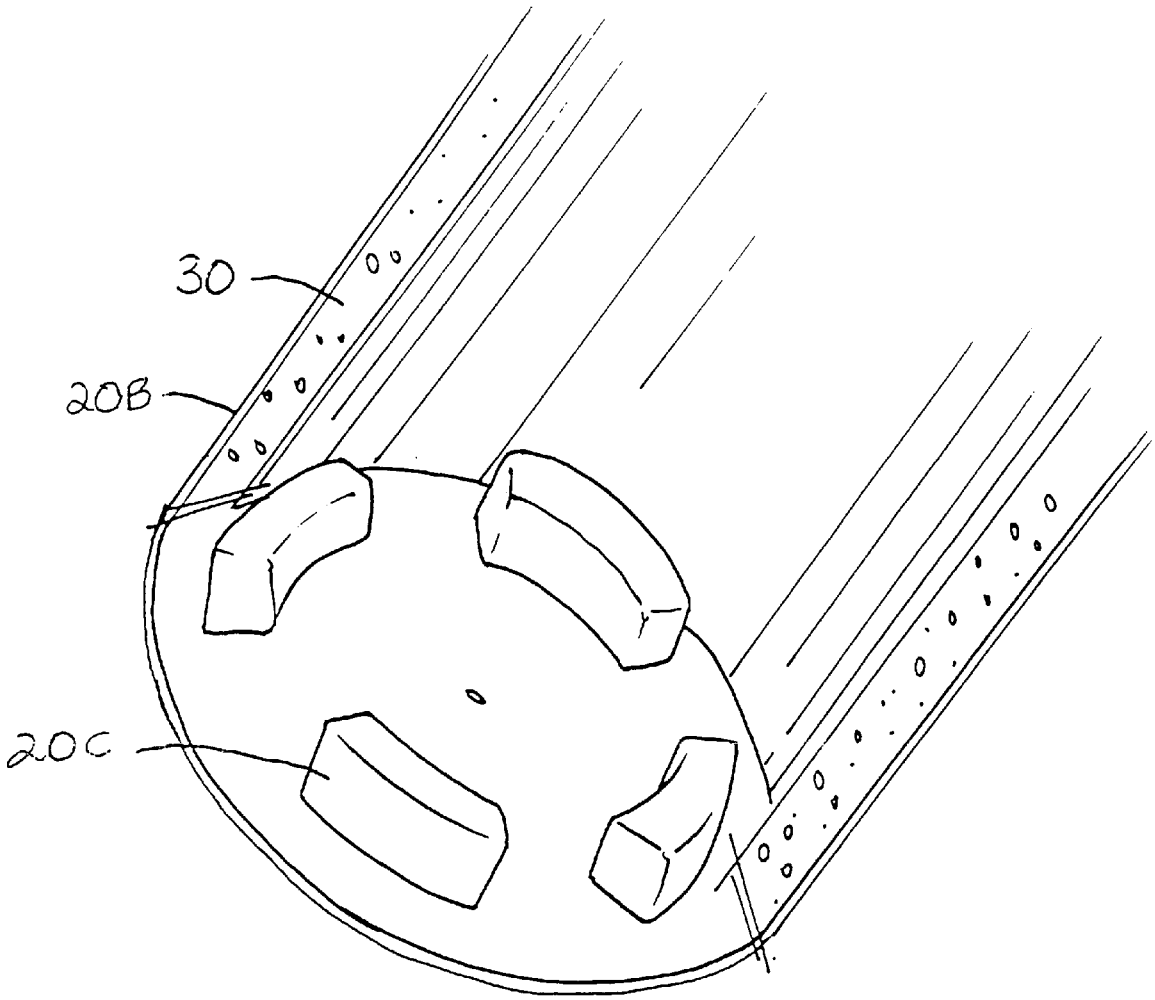
FIG. 2 is a cut-out perspective view of the preferred embodiment of the present invention showing the placement of the holding lips and the placement of the cooling sponge.

A preferred embodiment of the beverage cooling unit of the present invention is illustrated in FIG. 1A. This figure shows a frontal view of the three components of this invention, with a description of each to follow. Referring to FIG. 1A, a circular, threaded lid 10 is threaded down and securely fastened to opposite threads 20A. Opposite threads 20A are 5 millimeters high. Container structure 20 is designed to accommodate the cooling sponge 30 and still accept a standard soda can 50. When cooling sponge 30 and standard soda can are fastened into the container structure 20 by threaded cap 10, this creates a snug fit for maximum cooling efficiency.

Circular cap is 40 millimeters in diameter and has an edge that extends down perpendicularly from the top or horizontal face of this cap and entirely encompasses the cap's perimeter. The inner side of this cap's perpendicular edge is a spiral threaded region 10A.

Container structure 20 is 120 millimeters high and has a wall thickness (20B) of 2 millimeters. Container structure 20 has one open end to facilitate placement of the cooling sponge and soda can and a closed end with 4 staging lips 20C pressed into the bottom of the container structure. Lips 20C support the standard soda can within the container. Staging lips 20C are 20 millimeters high, have a 5 millimeter radial thickness, and begin at a radius of 20 millimeters from the container center.

Cooling sponge 30 is 4 millimeters thick and 118 millimeters high and extends circularly around the interior of container structure 20. Cooling sponge 30 is radially spaced from the container structure center at a radius of 34 millimeters, with the outside of cooling sponge at a radius of 38 millimeters from container structure center. Cooling holes 40 exist in the container structure 20 and provide for cooling liquid to evaporate from the sponge and cool the contained standard soda can.

Operation of the self cooling beverage cooling is relatively simple. An individual merely selects his favorite standard sized canned beverage; Coca-Cola®, Sprite®, Pepsi®, etc. Unlike other prior art, the cooling process can begin whenever there is available cooling liquid such as potable or non-potable water. Whenever the user is ready to enjoy a chilled beverage, he/she simply soaks or wets the cooling sponge 30 by immersing the container in liquid, preferably potable or non-potable water.

After the cooling sponge 30 is thoroughly soaked, the user places the standard soda can inside the container 20. Staging lips 30 support the standard soda can and keep it elevated from the container floor. User then screws down the lid 10 creating a snug fit and maximum cooling efficiency. The user then simply places the container in the open air, preferably in a mild breeze. As the water evaporates from the sponge, the evaporative process draws heat from the surface of the can which in turn cools the contents of the soda can.

Cooling efficiency can be regulated by the size and efficiency of the cooling sponge or evaporative material. Some material types work better than others. Ambient environment and prevailing winds also have an effect on cooling efficiency. Strategic placing of the cooling holes 40 and placing the staging lips 20B so that an air pocket 60 exists underneath the standard soda can.

Although the foregoing invention has been described in some detail by way of illustration and example for purposes of clarity and understanding, certain modifications will be obvious to those of skill in the art. Such modifications may be practiced within the scope of the present invention, which is limited solely by the appended claims and their legal equivalents, rather than by the examples given.

What is claimed is:

1. A hand held container for cooling a beverage within a standard beverage can, the container comprising:

a cylindrical container structure having a first end and a second end, the container structure defining a cavity and having a plurality of radial openings, wherein the cavity removably receives at least a portion of the can through the first end;

a layer of sponge material disposed along an inner surface of the container structure so as to engage an outer surface of the can when the can is disposed therein;

a top releasably affixable to the first end of the container structure so as to restrain the can within the cavity.

* * * * *